US005363548A

United States Patent [19]

Forsberg et al.

[11] Patent Number: 5,363,548

[45] Date of Patent: Nov. 15, 1994

[54] SHEET-WOUND COILS

[75] Inventors: Erik Forsberg, Smedjebacken; Lennart Lundström, Bjästa; Uno Zetterlund, Ludvika, all of Sweden

[73] Assignee: Asea Brown Boveri AB, Västerås, Sweden

[21] Appl. No.: 961,689

[22] PCT Filed: Jul. 1, 1991

[86] PCT No.: PCT/SE91/00471

§ 371 Date: Jan. 6, 1993

§ 102(e) Date: Jan. 6, 1993

[87] PCT Pub. No.: WO92/02941

PCT Pub. Date: Feb. 20, 1992

[30] Foreign Application Priority Data

Aug. 7, 1990 [SE] Sweden ..... 9002585-9

[51] Int. Cl.[5] ..... H01F 27/28

[52] U.S. Cl. ..... 29/605; 228/110.1; 29/602.1; 336/220; 336/232

[58] Field of Search ..... 336/220, 223, 232, 180; 29/602.1, 606, 605; 228/110.1, 179.1

[56] References Cited

U.S. PATENT DOCUMENTS

| | | | |
|---|---|---|---|
| 3,195,088 | 7/1965 | Sandoz | 336/180 |
| 3,668,588 | 6/1972 | Walsh, Jr. | 336/220 X |

FOREIGN PATENT DOCUMENTS

| | | | |
|---|---|---|---|
| 77214 | 2/1954 | Denmark | 336/180 |
| 74115 | 6/1980 | Japan | 336/223 |
| 120116 | 9/1990 | Japan | 336/223 |
| 4215413 | 8/1992 | Japan | 336/180 |

*Primary Examiner*—Leo P. Picard
*Assistant Examiner*—L. Thomas
*Attorney, Agent, or Firm*—Watson, Cole, Grindle & Watson

[57] ABSTRACT

A procedure when joining the tail ends of sheet-wound coils stacked one on top of the other around an inductive apparatus core with a certain axial space between them, the joint being effected using a thin leader strip which is connected to adjacent parts of the coils and joined to the coils along almost one coil turn.

5 Claims, 1 Drawing Sheet

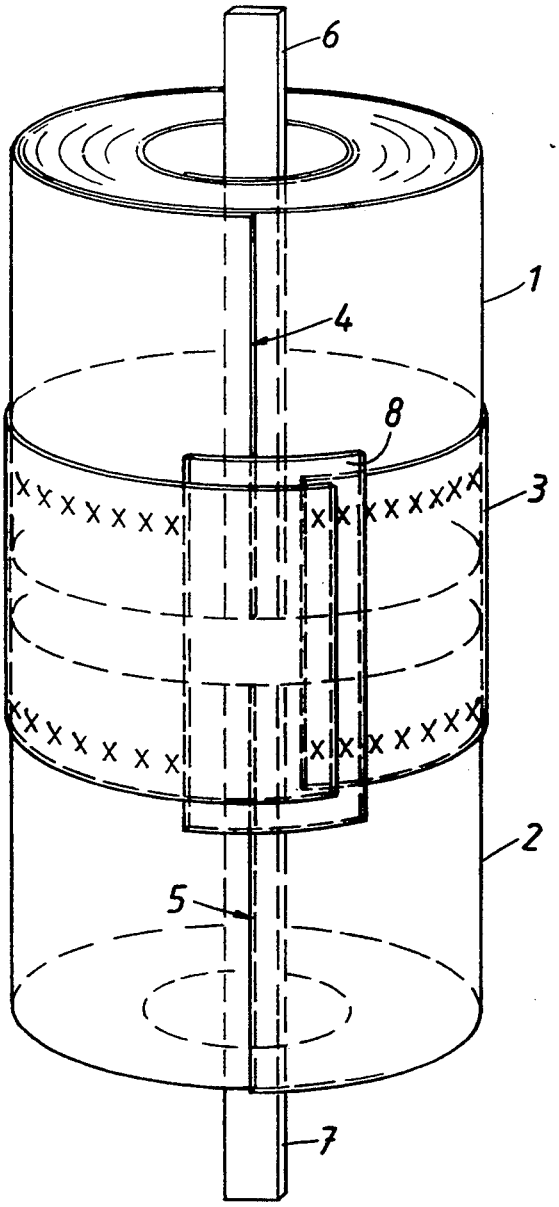
6
1
4
8
3
2
5
7

SHEET-WOUND COILS

TECHNICAL FIELD

Transformers are often provided with sheet-wound coils. A coil on an inductive apparatus core may then consist of two or more wound part-coils stacked one on top of the other, which must be joined together in some way. The present invention comprises a procedure for achieving this.

BACKGROUND ART

Sheet-wound coils are often used as low-voltage coils and consequently conduct relatively high currents. The output conductors must therefore be dimensioned accordingly.

When two sheet-wound coils are stacked one on top of the other around a common transformer core with a certain axial space between them, the two sheet-wound coils are identical. However, they are stacked and joined in such a way that, from the winding-direction point of view, they are directed towards each other. This means, therefore, that if a current travels for an instant from the inner layer of one coil to its outer coil, the current from the outer layer of the other coil will continue to the inner layer of the second coil.

It is thus the outer sheet layers of the coils that are joined, i.e., the exterior of the coils. This requires space when electrically dimensioning the main channel to the outer coil. It is therefore of great importance that a joint requires as little space radially as possible.

Coils have previously been joined with the aid of a copper bar in the final turn. If the area of sheet and bar is the same, with a sheet dimension of $0.5 \times 1000$ mm and bar width of 80 mm, for instance, the bar thickness will be 6.25 mm.

SUMMARY OF THE INVENTION

The invention permits connection of stacked coils without their having to be provided with terminals. Each coil is wound approximately a half turn more than is necessary in conventional bar splicing as described above. The coils shall be stacked with respect to winding direction in accordance with the state of the art and shall also be arranged radially so that their outer tail ends are located on a generatrix substantially common to the coils.

The invention comprises winding a thin strip of conducting material around the coils and attaching this in some suitable manner to the outer layer of the coils along almost one coil turn. The equally large portion of the coils' periphery which is not joined by the thin strip is necessary to prevent short-circuiting of the coil layers. The above-mentioned generatrix which coincides with the tail ends of the coils is arranged to lie substantially centrally in the unjoined portion.

The thin strip which thus joins the outer layers of the two coils must of course be dimensioned to ensure a sufficiently large contact area between this and the outer coil layers and that the current endurance will be at least the same as for the rest of the sheet-wound coil. The thickness of the thin surrounding strip is 0.1–0.5 mm and therefore offers a considerable saving in space in comparison with the current state of the art.

As mentioned, the stacked coils must be spaced a certain distance from each other in axial direction. The thin strip wound around the coils also covers the channel formed between the coils, like a belt. The belt thus electrically screens and protects the corners of the coils facing this channel. To also protect the part of the corners in the above-mentioned unjoined portion of the thin strip, this strip is extended to overlap. However, insulating the overlapping portion from the layer below, will prevent the belt from forming a closed turn of the coil.

If now the coils located closest to a transformer core as above constitute a part of a secondary winding, a corresponding part of the primary winding will be located outside these. Such a primary winding can also be constructed as a sheet-wound coil. In order to take full advantage of an exterior belt, the belt concept should also be utilized as an inner belt for sheet-wound coils outside the belt.

An inner belt can be joined to the coils inside it in the same way as described for the outer coil layers. For the same reason as above, an inner belt should also be provided with overlap and an insulation intermediate portion.

The procedure described offers considerable savings in space as well as higher performance and efficiency than has been the case in previous procedures for joining sheet-wound coils.

BRIEF DESCRIPTION OF THE FIGURE

The accompanying FIGURE depicts two sheet-wound coils positioned one above the other and joined by a wrapping belt according to the method of the invention.

DESCRIPTION OF THE PREFERRED EMBODIMENT

The accompanying FIGURE shows a preferred embodiment of the invention and illustrates how two stacked coils 1 and 2 can suitably be joined together with the aid of a belt 3. It is also seen, as previously described, how the tail end of the outermost layer of coil 1 terminates at 4, i.e., that the winding direction is clockwise, and that coil 2 terminates at 5 and the winding direction is counterclockwise. Coil 1 has a bar 6 as its inner terminal and the corresponding inner terminal for coil 2 is a bar 7.

As mentioned above, the belt 3 consists of a thin strip, preferably of the same material as the sheet-wound conducting material. The belt and the outer coil layers can be effected in many different ways, such as ultrasonically or using spot or seam welding. The joint is indicated by xxx in the drawing. The welded areas of the belt to the outer coil layer must be sufficient to fulfill the requirement of sufficiently low transition resistance.

As is evident, the belt also forms an electrical screen for the edges of the coils facing each other. To obtain full protection around the entire periphery, a certain peripheral overlapping of the belt is necessary. To prevent this overlap from causing the belt to form a closed coil turn, the overlapping parts must be electrically isolated. This is suitably achieved by placing an insulating strip 8 between the overlapping parts of the belt. The insulating strip should have such peripheral extension that it more than covers the part of the belt which is not joined to the outer coil layers.

The inner belt described earlier is applied in the same way as the exterior belt, the belt being joined with overlap to the inner coil layers of the sheet-wound coil, and with an insulating strip at the overlap. The external terminals of these outer coils may then comprise bars connected to the coil ends terminating outside. There is normally always sufficient space for these outer terminals.

We claim:

1. A method of joining sheet-wound coils stacked one on top of the other with an axial space therebetween comprising:

stacking a first coil having a top surface and a bottom surface on top of a second coil having a top surface and a bottom surface leaving a space between the bottom surface of the first coil and the top surface of the second coil, wrapping a belt consisting of a thin leader strip having a leading end and a tail end covering the bottom surface of the first coil, the top surface of the second coil and the space therebetween; and connecting the leader strip to the bottom surface of the first coil and the top surface of the second coil along one coil turn.

2. A method according to claim 1, wherein said leader strip is made of the same material as the material of said sheet-wound coils.

3. A method according to claim 1, wherein said leader strip is sufficiently long that said leading end thereof overlaps said tail end thereof.

4. A method according to claim 1, including the step of inserting an insulating strip between said leading end and said tail end of said leader strip.

5. A method according to claim 1, wherein said leader strip is connected to said first and second coils by ultrasonic welding.

* * * * *